US005145107A

United States Patent [19]

Silver et al.

[11] Patent Number: 5,145,107

[45] Date of Patent: Sep. 8, 1992

[54] INSULATED PAPER CUP

[75] Inventors: Virginia K. Silver, Chester; Robert L. Gordon, Monroe, both of N.Y.

[73] Assignee: International Paper Company, Purchase, N.Y.

[21] Appl. No.: 804,641

[22] Filed: Dec. 10, 1991

[51] Int. Cl.[5] ..... B65D 3/22

[52] U.S. Cl. ..... 229/1.5 B; 220/468; 220/469; 229/4.5

[58] Field of Search ..... 229/1.5 B, 4.5, 125.19; 220/410, 411, 425, 468, 469; 215/12.1

[56] References Cited

U.S. PATENT DOCUMENTS

| | | | |
|---|---|---|---|
| 1,679,621 | 8/1928 | Myers | 220/411 |
| 1,771,765 | 7/1930 | Benson . | |
| 1,955,745 | 4/1934 | Hurley | 220/441 |
| 2,266,828 | 12/1941 | Sykes | 220/441 |
| 2,287,610 | 6/1942 | Guidry | 229/1.5 B |
| 2,591,578 | 4/1952 | McNealey et al. . | |
| 2,675,954 | 4/1954 | Vogel | 229/1.5 B |
| 2,828,903 | 4/1958 | Adkins | 220/447 |
| 3,079,027 | 2/1963 | Edwards | 229/1.5 B |
| 3,229,478 | 1/1966 | Alonso . | |
| 3,443,714 | 5/1969 | Edwards | 206/520 |
| 3,456,860 | 7/1969 | Janninck | 229/1.5 B |
| 3,580,468 | 5/1971 | McDevitt | 220/447 |
| 4,007,670 | 2/1977 | Albano et al. | 206/DIG. 11 |
| 4,040,537 | 8/1977 | Edwards | 229/1.5 B |

FOREIGN PATENT DOCUMENTS

| | | | |
|---|---|---|---|
| 2331005 | 1/1975 | Fed. Rep. of Germany | 229/1.5 B |
| 2418141 | 10/1975 | Fed. Rep. of Germany | 229/4.5 |
| 1167861 | 10/1969 | United Kingdom | 229/1.5 B |

*Primary Examiner*—Gary E. Elkins
*Attorney, Agent, or Firm*—Michael J. Doyle; Walt Thomas Zielinski

[57] ABSTRACT

An insulated paper cup having inner and outer frustoconcial shells, the inner shell being more tapered than the outer shell. The upper rims of both shells are outwardly curled and joined together. The outer shell has a recessed bottom upon which the bottom of the inner shell rests. The inner surface of the inner shell is coated with a plastic film such as polyethylene.

3 Claims, 1 Drawing Sheet

INSULATED PAPER CUP

BACKGROUND OF THE INVENTION

This invention relates to containers and more particularly to a paper cup intended for the dispensing and serving of either hot or cold drinks.

Paper cups are widely used in the beverage art for holding hot or cold drinks, such as coffee or fruit juices. Employed for holding hot drinks, a single thickness wall of a typical paper cup permits relatively rapid heat loss. Further, when the user grasps the cup to drink from it, if the liquid is still fairly hot, there exists a danger of a burn to the fingers. These two disadvantages have sought to be overcome in the prior art by a number of constructions, such as shown in U.S. Pat. Nos. 1,771,765 issued to Benson; 2,266,828 issued to Sykes; 2,591,578 issued to McNealy; 2,675,954 issued to Vogel; and 2,828,903 issued to Adkins. While at least partially successful in providing an insulated cup, the constructions shown in these patents do not yield the advantages of the present invention.

SUMMARY OF THE INVENTION

According to the practice of this invention, an insulated paper cup is formed from two paper shells, each of generally frustoconical shape and each having a bottom, the outer shell being provided at its upper rim or periphery with an outwardly directed curl. The inner shell is coated on its interior surface with a plastic film, such as polyethylene, and its upper rim or periphery is curled over the curl of the outer shell. Such double curling enhances the rigidity of the cup. Preferably, the bottom of the inner shell rests upon the bottom of the outer shell, with the bottom of the outer shell being recessed, i.e., the bottom extends above the lower periphery of the outer shell. A recessed bottom is sometimes termed a false bottom. One of the significant features of the present invention is the difference in taper between the outer shell and the inner shell. Typically, the difference in taper is one to three degrees. This provides an insulating air space between the side walls of the two shells, with this insulating air space increasing in thickness towards the bottom of the cup. When a cup having a hot liquid therein is grasped, usually the forefinger and thumb contact the rim of the cup, with the remaining fingers contacting the cup at its middle and lower portions. Since cups are not usually filled to the brim, the forefinger and thumb do not receive full heat transfer from the hot liquid. However, those portions of the cup which are lower are accordingly heated the most and hence subject to burning of the finger tips. By virtue of the increased thickness of the air space at the lower portion of the cup, such burning of the fingers is inhibited. Further in accordance with the practice of the invention, the caliper of the paper which is used to form both the outer and inner shells is less than that of the conventional calipers cup used to form the composite cup. This difference in caliper represents a saving of paperboard and cost and is made possible by the bottom of the inner shell being supported on the bottom of the outer shell. Further, this double wall construction isolates the hot liquid from the outer shell.

DETAILED DESCRIPTION OF THE INVENTION

Figure 1:
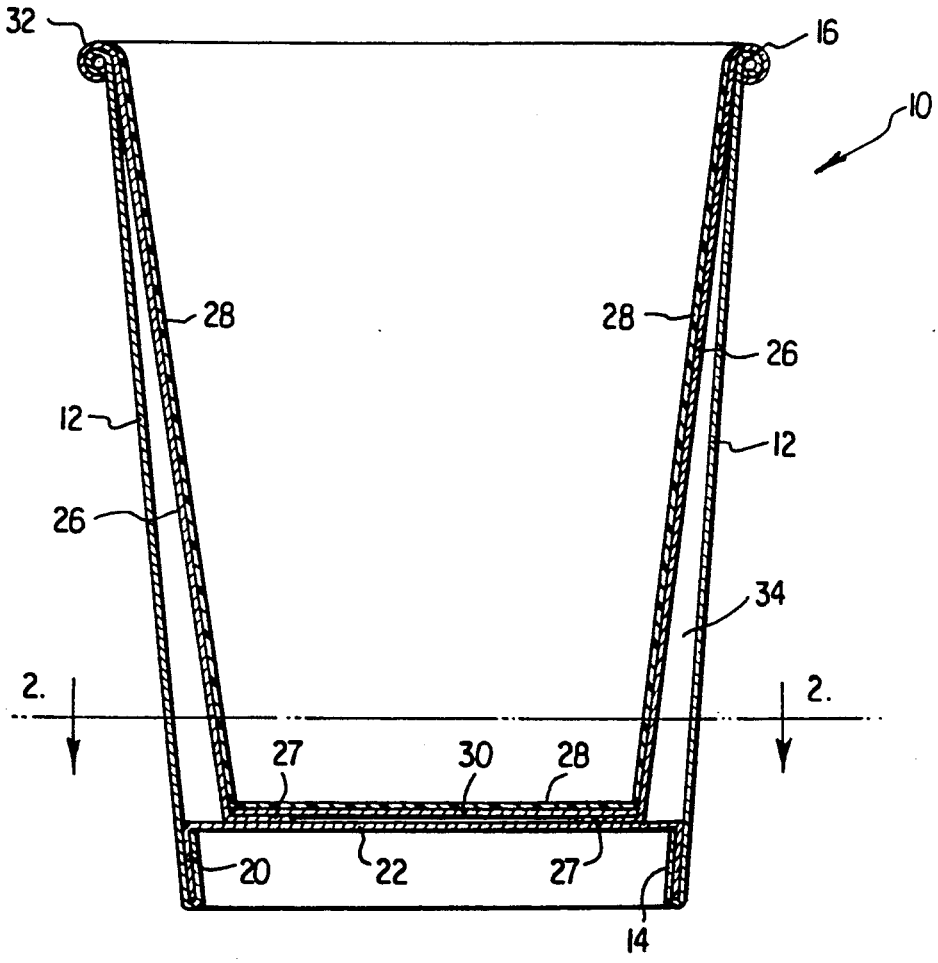
FIG. 1 is an elevational cross sectional view illustrating the insulated cup of this invention.
Figure 2:
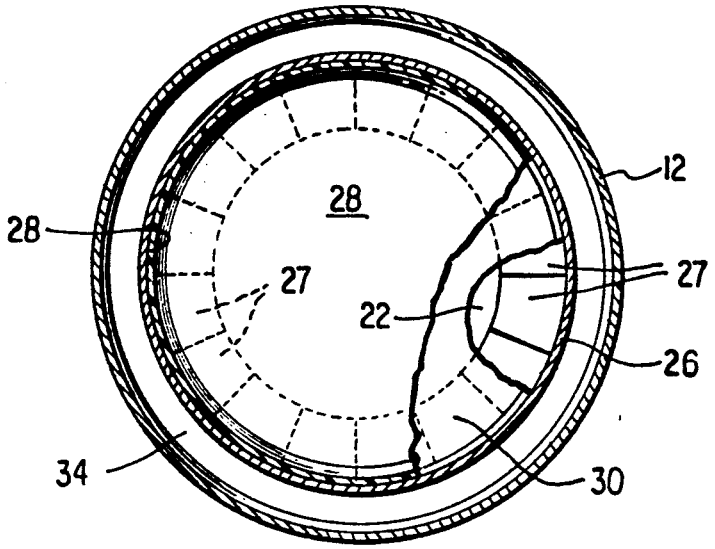
FIG. 2 is a view taken along section 2—2 of FIG. 1.

Referring now to the drawings, the numeral 10 denotes generally the insulated cup of this invention and includes an outer shell 12 fashioned from paperboard. Shell 12 is in the general form of a circular cone truncated at its pointed end and termed frustoconical in shape. The lower periphery of shell 12 is indicated by 14 and bends upwardly into substantial parallelism with the outside of shell 12. The upper rim of the outer shell is curled radially outwardly and is denoted as 16. A downwardly extending flange 20, which may be circumferentially divided into tabs, is secured to a disc 22 with the flange or skirt 20 firmly sandwiched between upwardly extending flange 14 of the outer wall of shell 12. This produces a bottom 22 which is elevated above the lower rim of the outer shell. The reader will understand that the elevated or false bottom need not be fashioned in this exact manner. Namely, elements 14 and 22 may be integral as shown at FIG. 4 of the noted Vogel patent, with the lower bottom closure centrally apertured.

The inner shell is denoted as 26 and is also in the form of a circular conical paperboard sheet member also of frustoconical form. Both the inner and outer shells may be considered as tapered paper shells. The entire inner surface of the inner shell including its bottom is coated with a thin plastic film, denoted as 28, and may be any one of known films of this type, such as polyethylene. The upper periphery of outer shell 26 is curled over curl 16 of the outer shell, this radially outwardly curling of the top periphery or rim of the inner shell denoted as 32. It will be seen that the two outward, annularly continuous curlings 16 and 32, in conjunction with each other, serve to provide a rigid upper periphery of the insulated cup of this invention and also to provide a radially outwardly extending ledge to assist in holding the cup with the thumb and forefinger. The bottom of the inner shell includes, conventionally, a paper disc 30 which rests on and is adhesively secured to circumferential tabs 27 at the lower end of shell 26. Tabs 27 rest on elevated bottom 22 of the outer shell. These two bottoms may be adhesively secured together. The constructions for both the inner and outer shells, individually, are known.

It will be observed that the taper of the inner shell is greater than the taper of the outer shell, with this difference in tapers providing a dead air spaced denoted as 34, with the thickness of any horizontal section of this dead air space being greater at the lower part of the cup than at the upper part. This construction inhibits contact between the outer and inner shells near the bottom of the cup where it is often squeezed the hardest by the fingers.

In one example of an insulated cup fashioned in accordance with the present invention, the caliper of the outer shell 12 is about 0.012 inches, while the caliper in this invention may be reduced to about 0.008 inches. This reduces cost and material. The inner cup at a taper of approximately six degrees, while the taper of the outer cup was approximately five degrees.

It will also be noted that due to the absence of a polyethylene or other plastic film coating on the outer shell of the insulated cup, suitable graphics may be printed thereon.

We claim:

1. An insulated paper cup construction including an outer tapered paper shell having an upper rim around an upper portion thereof and a recessed bottom closure, the upper rim of said outer shell being curled downwardly and radially outwardly, the construction further including an inner tapered paper shell having an upper rim around an upper portion thereof and a bottom closure, the upper rim of said inner shell being curled downwardly and radially outwardly and being curled over and around the upper portion of said outer shell, the taper of said inner shell being greater than the taper of the outer shell to thereby define a tapered air space between said shells, said inner shell having an inner surface which is coated with a plastic film, the caliper of paper of the outer shell being the same as that of the inner shell, said bottom closure of the inner shell resting on said bottom closure of the outer shell.

2. The insulated paper cup construction of claim 1 wherein the caliper of said outer and inner paper shells is between 0.012 and 0.008 inches.

3. The insulated paper cup construction of claim 2 wherein the taper of said inner cup is approximately six degrees and the taper of said outer cup is approximately five degrees.

* * * * *